United States Patent [19]

Idota et al.

[11] 4,013,527

[45] Mar. 22, 1977

[54] ELECTROLYTIC OXIDATION OF BLIX SOLUTION

[75] Inventors: Yoshio Idota; Haruhiko Iwano; Kazuo Shirasu; Sachio Matsushita, all of Minami-ashigara, Japan

[73] Assignee: Fuji Photo Film Co., Ltd., Minami-ashigara, Japan

[22] Filed: Aug. 4, 1975

[21] Appl. No.: 602,167

[30] Foreign Application Priority Data

| | | |
|---|---|---|
| Aug. 5, 1974 | Japan | 49-89604 |
| Aug. 7, 1974 | New Zealand | 90545 |
| Aug. 8, 1974 | Japan | 49-91033 |

[52] U.S. Cl. ..... 204/151; 204/109; 204/130; 204/149

[51] Int. Cl.[2] ..... C25C 1/20

[58] Field of Search ..... 204/149, 130, 131, 46 R, 204/151, 180 P

[56] References Cited

UNITED STATES PATENTS

| | | | |
|---|---|---|---|
| 3,642,594 | 2/1972 | Crellin | 204/149 |
| 3,647,422 | 3/1972 | Wainer | 204/151 X |
| 3,719,570 | 3/1973 | Lancy | 204/151 |
| 3,761,369 | 9/1973 | Tirrell | 204/151 |
| 3,764,503 | 10/1973 | Lancy et al. | 204/151 X |

*Primary Examiner*—Arthur C. Prescott
*Attorney, Agent, or Firm*—Sughrue, Rothwell, Mion, Zinn & Macpeak

[57] ABSTRACT

A process for electrolyzing a bleach-fixed solution, or blix solution, used in processing color photographic materials, which contains originally an iron (III) chelate compound and a silver halide solvent in an electrolytic bath and separating the cathode compartment and the anode compartment of the electrolytic cell with a porous membrane and controlling the anode potential so that the silver halide solvent does not decompose. Embodiments include use of a carbon fiber as the anode and also controlling the cathode potential and the current densities of the cathode and the anode.

14 Claims, 5 Drawing Figures

FIG. 1
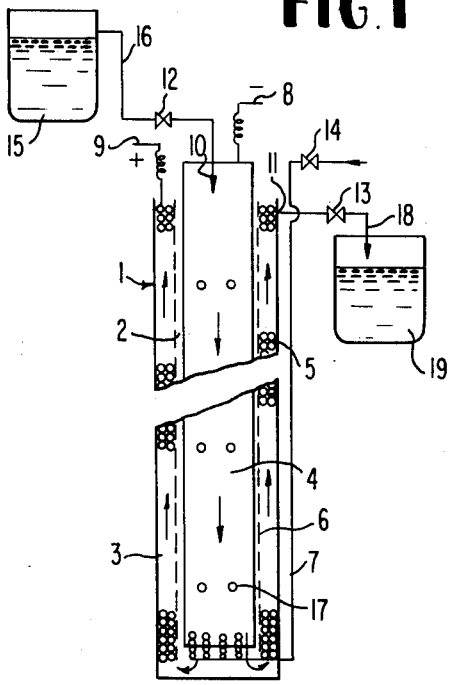
FIG. 2
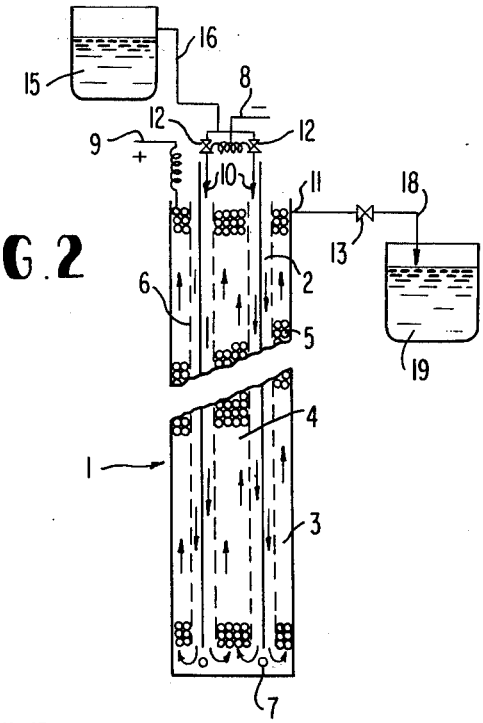
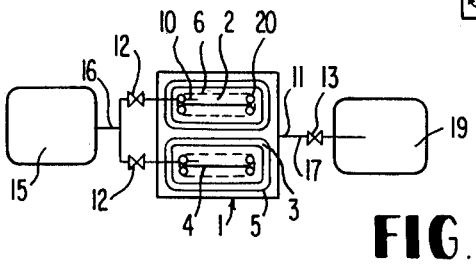
FIG. 3
FIG. 4
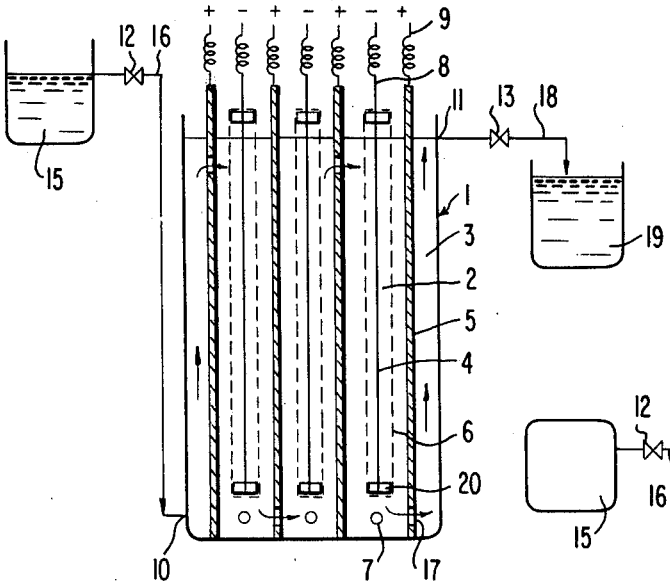
FIG. 5
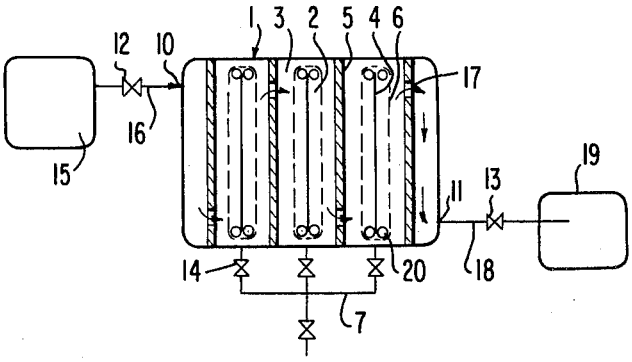

ELECTROLYTIC OXIDATION OF BLIX SOLUTION

BACKGROUND OF THE INVENTION

1. Field of the Invention

The present invention relates to electrolytic oxidation of a blix solution. More particularly, the present invention relates to a regeneration of a used blix solution and the electrolytic cell materials and procedures for use in the electrolytic oxidation of a photographic blix solution.

2. Description of the Prior Art

A silver halide color photographic material is processed in the two steps of color-development and de-silvering. On color-development of the color photographic material, the exposed silver halide is reduced to form silver, and at the same time, the oxidized aromatic primary amino developing agent reacts with a coupler to form a color image. The silver produced by the development is, at the de-silvering step, oxidized by a bleaching agent (oxidizing agent) into a silver halide which is then dissolved in and removed by a silver halide solvent.

In this way, the de-silvering stage involves the two steps of bleaching and fixing. In practical photographic processing, a blix stage in which both the bleaching step and the fixing step are carried out simultaneously is employed, as well as a method in which the bleaching step and the fixing step are carried out separately. The former method is described in, for example, U.S. Pat. No. 3,582,322.

The iron (III) chelate compound contained in the blix solution oxidizes the silver developed during the processing, and at the same time, the iron (III) chelate compound is reduced a di-valent iron salt. On the other hand, the silver ions produced by the oxidation are dissolved in a fixing agent. Therefore, with continuing processing, the iron (II) salt and silver complex salt gradually accumulate in the blix solution, and as a result of the accumulation, the activity of the blix solution is reduced, with fatigue thus occurring. This problem can be solved by adding a suitable amount of a supplemental solution to the blix solution during the development processing and by overflowing the used solution from the tank. This method, however, is not desirable from the standpoint of environmental pollution, and also from an economical standpoint. Thus it is quite desired and advantageous that the activity of the solution be restored so as to enable the solution to be reused.

In general, a method of recovering silver from the fixing solution can be utilized in recovering silver from the blix solution.

The following silver recovery methods are well known in the field of photography.

1. A method in which a compound capable of forming an insoluble silver salt is added to the solution (silver precipitation method)

2. A method in which a metal having a higher ionization tendency than silver is contacted with the solution (metal substitution method)

3. A method in which silver is deposited on the cathode in an electrolytic bath (electrolytic method)

4. A method in which an ion exchange resin is used (ion exchange method)

The details of these methods are described in M. L. Schreibe, "Present Status of Silver Recovery in Motion-Picture Laboratories", J. SMPTE, Vol. 74, pp. 505 to 514 (1965).

On the other hand, the following methods of oxidizing iron (II) ions produced in the used solution have been proposed.

1. A method in which an oxidizing agent is added, as described in, for example, U.S. Pat. Nos. 3,615,507 and 3,767,401, and West German Pat. (OLS) No. 2,149,314.

2. A method in which oxygen (air) is contacted with the solution, as described in, for example, U.S. Pat. Nos. 3,634,088, 3,700,450, and 3,813,246.

3. An electrolytic oxidation method as described in, for example, Japanese Pat. (OPI) No. 18191/1973.

In oxidation methods (1) and (2) above, an oxidizing agent is added, and sulfite ions and thiosulfate ions contained in the solution are oxidized. Thus unwanted materials accumulate in the regenerated solution. Therefore, the removal of the unwanted materials accumulated and replenishment of the deficiency in the desired components is required in these methods. On the other hand, in the electrolytic oxidation method (3), since the oxidation proceeds without any chemical reactions occurring, iron (II) ions alone are efficiently converted into iron (III) ions. Thus the electrolytic oxidation method is a preferred method.

However, if the silver recovery is carried out simultaneously with the oxidation of the iron (II) in accordance with the electrolytic oxidation method, the reduction of the iron (III) ions takes place simultaneously with the reduction of the silver complex ions in the reduction process, i.e., on the cathode, and thus a large oxidation current is needed at the anode. The reason for this is that if the oxidation is insufficiently carried out, the blix solution reproduced does not have a sufficient bleaching action. Furthermore, at the anode, the sulfite ions and thiosulfate ions are oxidized at the same time. Therefore, it is quite insufficient from an industrial standpoint for the oxidation of the iron (II) ions and the silver recovery to be simultaneously carried out using an electrolytic method.

In particular, if the thiosulfite and sulfate ions are decomposed, the blix solution must be supplemented with the corresponding amount of these ions decomposed, and thus this method suffers from the serious problem that the advantage of the regeneration operation is lost from an economical standpoint.

Furthermore, the accumulation of the sulfate ions and the like produced by decomposition causes the clearing time to increase, and the sulfur ions produced by reduction cause silver sulfide to be formed.

SUMMARY OF THE INVENTION

An object of the present invention is to provide a process for the electrolytic oxidation of a blix solution in which the silver recovery and the oxidation of iron (II) are carried out simultaneously and highly efficiently.

Another object of the present invention is to provide a process for the electrolytic oxidation of a blix solution in which the oxidation of thiosulfate ions and sulfite ions are controlled and the oxidation of iron (II) ions alone is carried out efficiently.

A further object of the present invention is to provide a process for the electrolytic oxidation of a blix solution which enables a blix solution having a high bleaching action to be regenerated.

Another object of the present invention is to provide anodic materials suitable for the electrolytic oxidation of a blix solution.

It has been found that if a used blix solution is electrolyzed by conventional methods, the solution at the anode area, i.e., an oxidizable atmosphere, and the solution at the cathode area, i.e., a reducible atmosphere, are mixed whereby the regenerated blix solution contains iron (II) ions, and thus the regenerated blix solution has an insufficient oxidation action and it is difficult to re-use the blix solution.

In one embodiment of this invention the objects of this invention are obtained in a process for the electrolytic oxidation of a used blix solution obtained in processing color photographic materials comprising electrolytically oxidizing the used blix solution which originally contained an iron (III) chelate compound and a silver halide solvent in an electrolytic cell in which the anode compartment and the cathode compartment are separated with a porous membrane, and also by controlling the anode potential in electrolyzing the used blix solution to prevent the silver halide solvent from being decomposed.

In another embodiment the present invention provides a process for the electrolytic oxidation of a used blix solution in processing color photographic materials, comprising electrolyticly oxidizing the used blix solution which originally contained an iron (III) chelate compound and a silver halide solvent, as described above and additionally using a carbon fiber as the anode.

In a further embodiment of this invention these objects are attained by electrolyzing a used blix solution as described above, while feeding continuously the blix solution from the cathode compartment into the anode compartment and while controlling the cathode potential, the anode potential, and the current densities of the anode and cathode so as to prevent the silver halide solvent from decomposing.

BRIEF DESCRIPTION OF THE DRAWINGS

FIGS. 1 to 5 are sectional views of an apparatus showing an embodiment of the present invention.

DETAILED DESCRIPTION OF THE INVENTION

The present invention will be explained by reference to the drawings. FIGS. 1, 2, and 3 are, respectively, a front view, a side view, and a plan view of an electrolytic cell showing an embodiment of the present invention. FIGS. 4 and 5 are, respectively, a front view and a plan view of an electrolytic cell showing another embodiment of the method of the present invention.

In FIG. 1, an electrolytic cell 1 comprises a cathode compartment 2, an anode compartment 3, a cathode 4, an anode 5, a membrane 6 separating the anode compartment 2 and the cathode compartment 3, and a nitrogen gas conduit 7. The cathode 4 and the anode 5 are connected to an electric source with two lead wires 8 and 9. An inlet 10 and an outlet 11 of the electrolytic cell can be opened and closed with valves 12 and 13, respectively.

The electrolytic cell is suitably made from insulating materials such as glass, hard rubber, wood, or synthetic resins. In particular, synthetic resins such as polyvinyl chloride, polymethyl methacrylate, polyethylene, polypropylene, polystyrene, and a phenol-formaldehyde resin are preferred.

The cathode can be made from any electrically conductive substances or semi-conductors which are durable for long use or for repeated use. In particular, stainless steel is preferred. On the other hand, the anode can be made of materials which do not melt on application of a voltage, and carbon (graphite), lead dioxide, platinum, gold, and the like can be used. In particular, it is advantageous that the anode is made of carbon. These electrodes can be in the form of plates, rods, particles, and fibers, that is, they are not limited in form. In the case where the anode is made of carbon, if a carbon fiber of low electric resistance is used, electrode potential, current density, and flow rate suitable for controlling the decomposition of the sulfite and thiosulfate ions can be advantageously obtained.

The term "low electric resistance" as used herein means that the electric resistance of all the anodes in the state of use (the state in which the carbon fibers are wound around the membrane; in other words, the state where the carbon fibers are in contact with each other) is 5 Ω or less, preferably 3Ω or less (the lower limit is not restricted since the lower the better).

The term "carbon fiber" as used herein means a generally flexible carbon fiber having a monofilament diameter on the order of from about 1 to about 50 μ, preferably about 5 to 12 μ. The effect of the present invention does not change even though the diamter of the fiber is increased. However, those fibers having high elasticity are preferred since the handling becomes troublesome if the fibers are broken. In using carbon, a plurality of monofilaments can be bound to form a thread in order to increase the mechanical strength. The diameter of the thread will vary depending upon the purpose and method of producing the thread, and thus the diameter can vary.

The carbon fiber can be in the form of a felt, a twill, a plain weave fabric, a string, a laminate, or the like. In the present invention, those carbon fibers in the form of a felt, a twill, a plain weave fabrics, or a string are preferred. Furthermore, in effecting the electrolysis, the carbon fiber and carbon plates or carbon rods can be used in combination with each other as the anode. These carbon fibers are described in Otani and Kimura, Tanso Seni (Carbon Fiber), Kindai Hensyu Sya, Tokyo (1972).

The use of carbon fibers for silver recovery by electrolysis is described in West German Pat. (OLS) No. 2,333,018. The gist of this method is the use of the carbon fibers as the cathode which facilitates the silver recovery since the carbon fibers are combustible, that is, the silver deposited on the carbon fibers by electrolysis can be recovered by burning the carbon fibers.

In this method, however, the cathode and anode are both carbon fibers, and thus it is considered that the area ratio of the anode to the cathode is substantially 1. On the other hand, in one embodiment of the present invention, it is particularly important for carbon fibers to be used as the anodic materials alone and that the desired anode reaction is accelerated by making the area of the anode larger than that of the cathode (preferably, the area ratio of the anode to the cathode is more than about 2 to 1). That is, it is to be noted that the carbon fibers can be advantageously used as the means of increasng the area of the anode.

The membrane separating the anode compartment from the cathode compartment preferably is made from those materials which allow electrons and liquids to pass therethrough, but not large ions and molecules.

Examples of suitable materials are semipermeable membranes such as a cellulose acetate film whose surface is hydrolyzed, a cellophane film, a copper ferrocyanide film, a bladder membrane, an intestinal wall membrane, an agar film, and the like, an asbestos plate, a clay plate, a sintered glass, glass wool, micro-porous synthetic polymer films such as a polyvinyl chloride film, a polystyrene film, a polysulfone film, a polypropylene film, a polyester film, and the like.

While the use of the membrane reduces the current density and the electrolytic reaction amount, the amount of reduction is not as marked as compared with the blix solution which is obtained by the conventional electrolysis in which no membrane is used. However, the reduction of this order in the current density is negligible when the various advantages of the present invention are taken into consideration.

Referring again to FIG. 1, the blix solution is withdrawn from a storage tank 15 through a valve 5 and introduced into the cathode compartment 2 through the inlet 10. The cathode is provided with a number of pores 17 which permit the blix solution to pass therethrough. The blix solution is passed through the pores 17 and then between the cathode compartment and the membrane 6 to the bottom of the electrolytic cell 1. The blix solution is then introduced from the bottom of the electrolytic cell 1 to the anode compartment 3, and it is passed to the upper part of the electrolytic cell 1 along the membrane 6. Finally, the blix solution is passed from the outlet 11 through the pipe 18 into the storage tank 19.

When the electrolytic cell is filled with the used blix solution and electricity is passed through the cell, the desilvering proceeds in the cathode compartment and the oxidation of the iron ions proceeds in the anode compartment 3. If the anode potential is set within the following range, the present invention proceeds quite efficiently. In the method of the present invention, the anode potential is determined depending upon the amount of the compounds also present in the used blix solution, and in general, the anode potential can be set in the range that ensures the oxidation of the iron (II) ions. Taking into account the desire not to oxidize the sulfite and thiosulfate ions, the anode potential preferably is set at about −0.10 V to 0.50 V, preferably 0 to 0.30 V, and more preferably 0 to 0.20 V.

As the current density of the anode is decreased, the current efficiency becomes better, and in general, the current density is determined depending upon the current intensity, distance between the electrodes, the conductivity of the blix solution used, and the degree of agitation of the blix solution. For example, a suitable current density of the anode is about 0.7 A/dm$^2$ or less, preferably about 0.1 A/dm$^2$ or less, amd more preferably 0.05 A/dm$^2$ or less. However, the current density can be varied over a wide range since the area of the electrode can be changed appropriately.

In the method of the present invention, as described above, it is not necessary to carry out the de-silvering operation simultaneously. However, where the de-silvering operation is carried out simultaneously with the regeneration, the cathode potential is preferably taken into account. In general, the cathode potential is determined depending upon the silver ion concentration and the other components also present in the blix solution, and a sufficient cathode potential is at least that potential at which the silver ions can be reduced. Considering also the prevention of the reduction of the sulfite and thiosulfate ions, the cathode potential practically ranges from about −0.20 to −0.70 V, preferably from about −0.35 to −0.60 V, and more preferably from about −0.40 to −0.55 V. In general, as the cathode current density is decreased, the current efficiency is increased. In the present invention, the cathode current density is about 0.01 A/dm$^2$ or more, preferably about 0.05 A/dm$^2$ or more, and more preferably about 0.1 A/dm$^2$ or more. However, a similar situation as discussed above for the anode also exists for the cathode since the area of the electrode can be changed.

The term "electrode potential" as used herein designates the internal potential that the electrode phase has relative to the electrolyte solution phase which is in contact with the electrode. While it is impossible to measure the absolute value of the electrode potential, the relative value thereof can be determined by producing a cell through the combination of an electrode and a specific reference electrode, and then measuring the voltage between the terminals thereof. In the present invention, the electrode potential is measured using a saturated calomel electrode with a saturated potassium chloride-agar bridge as the reference electrode. In this case, the potassium chloride is used as the bridge for the purpose of reducing the contact potential difference as much as possible. However, since the solution to be measured is a solution containing silver ions, it is unsuited for use for a long period of time or for reuse, and thus use for a short period of time is desired.

The flow rate of the solution flowing into the electrolytic cell is practically not less than about 0.1 mm per hour, and preferably about from 10 to about 320 cm per hour or in other words is about 3 to 1000 liters/hr. The flow rate of the solution is determined depending upon the amount of the blix solution and the concentrations of the silver, iron, sulfite, and thiosulfate ions contained in the blix solution.

The method of the present invention can be carried out advantageously by agitating the solution in the anode compartment or the cathode compartment. The agitation can be carried out by, for example, bubbling an inert gas into the solution, mechanical stirring using a rotable bar or rotable cathode, electric stirring, or the like. In FIGS. 1, 2, and 3, the solution is stirred by bubbling nitrogen gas therethrough. That is, by introducing nitrogen gas through a nitrogen gas conduit 7 during the electrolysis, the effect due to stirring increases and the de-silvering efficiency increases. In this case, the diameter of the nitrogen gas bubbles preferably is as small as possible (in general, the diameter of the openings of the gas conduit ranges from about 5 $\mu$m to about 5 mm).

The method of the present invention can be carried out as either a batchwise or continuous operation. This is, in the batchwise operation, the used blix solution is regenerated separately from the blix processing step, whereas in the continuous operation, the overflow from the bath used in the blix processing is introduced into the above described silver recovery stage and then into the electrolytic cell, in which the used blix solution is regenerated, and the thus-regenerated solution is returned to the blix bath. In the latter operation, if the rate of the overflow is the same as that of the solution entering into the electrolytic cell, the reproduction process is ideal.

FIGS. 4 and 5 show an embodiment of the present invention in which a carbon plate is used in place of the carbon fiber and electrolysis is used as the silver recovering method. FIG. 4 is a front view of an electrolytic cell and FIG. 5 is a plan view thereof. In FIGS. 4 and 5, three pairs of electrodes are shown, but the number of the electrodes can be increased or decreased depending upon the amount of the used blix solution to be processed.

In accordance with the present invention, the silver recovery (cathode compartment) and the regeneration of the blix solution (anode compartment) can be carried out simultaneously, but the present invention also includes also an embodiment in which silver is previously recovered from the blix solution and the solution so treated is then regenerated. The removal of silver from the blix solution (de-silvering) can be accomplished by carrying out electrolysis previously or according to the above described conventional silver recovery. In this case, the solution is introduced from storage tank 15 through pipe 16 directly into anode compartment 3, and it is preferred that the bottom of membrane 6 is closed and inlet 10 is provided at the bottom of or a lower part of electrolytic cell 1.

Where a cathode compartment, whose bottom is closed, is used in the present invention, the aqueous solution is the cathode compartment may contain, in addition to the used blix solution, general supporting electrolytes as used in the field of electrochemistry such as anionic electrolytes, for example, nitrate ions, sulfate ions, organic acid ions, e.g., butyrate ions, citrate ions, tartarate ions, phthalate ions, oxalate ions, and the like, all of the halide ions, peroxide ions, e.g., persulfate ions, perchlorate ions, and the like, phosphorate ions, hydroxide ions, or cationic electrolytes, for example, alkali metal ions, e.g., sodium, potassium, lithium ions, and the like, hydrogen ions, ammonium ions, and the like, in concentrations suitable for passing an electric current therethrough (in general, from about 0.001 M/liter to a saturated solution concentration, and preferably from about 0.1 M/liter to about 0.9 x (the concentration of a saturated solution)). One of the most typical examples of an electrolyte is a 1N potassium nitrate aqueous solution.

In accordance with the method of the present invention, the pH of the regenerated solution does not increase, which is another advantage of the present invention. As the pH of the blix solution increases, the blixing capability of the blix solution tends to decrease, and thus if the pH of the regenerated blix solution is high, the regeneration processing becomes meaningless even though the processing proceeds efficiently. However, in accordance with the present invention, an increase in pH does not occur at all, and thus the method of the present invention is advantageous.

It is well known, as described above, that a ferric complex salt of an aminopolycarboxylic acid is used as a bleaching component of a blix solution. The aminopolycarboxylic acid-iron (III) complex salt is a complex salt of ferric ion and an aminopolycarboxylic acid or the salt thereof (chelating agent). Examples of aminopolycarboxylic acid salts include alkali metal salts of aminopolycarboxylic acids, and in addition, the ammonium salt and water-soluble amine salt can be used. Examples of suitable alkali metals are sodium, potassium, lithium, and the like, and of water-soluble amines are alkylamines such as methylamine, diethylamine, triethylamine, butylamine, and the like, alicyclic amines such as cyclohexyl amine, and the like, arylamines such as aniline, m-toluidine, and the like, and heterocyclic amines such as pyridine, morpholine, piperidine, and the like. Aminopolycarboxylic acids are aminopoly(tetra or more)carboxylic acids such as ethylenediamine tetraacetate, diethylenetriamine pentaacetate, ethyleneglycol bis(amino ethyl ether)tetraacetate, and the like, aminotricarboxylic acids such as N-(2-hydroxyethyl)ethylenediamine triacetate and the like, etc. The aminopolycarboxylic acid-iron (III) salts used in the present invention include ferric ions and two or more carboxy groups with at least one of the carboxy groups being in the form of an alkali metal salt. These salts include ethylenediamine tetraacetate iron (III) sodium salt and the like. Those salts containing mono-valent cations other than the alkali metal salts can also be used in the present invention. Furthermore, other than the above ferric salts, non-chelated salts of an aminopolycarboxylic acid such as the tetrasodium salt of ethylenediamine tetraacetate can be present.

The ferric ion complex salt can be used in the form of a complex salt, or the ferric ion complex salt can be formed in situ using a ferric salt, e.g., ferric sulfate, ferric chloride, ferric nitrate, ferric ammonium, ferric phosphate, and the like, and a chelating agent such as an aminopolycarboxylic acid. When the salt is used in the form of complex salt, the complex salts can be used alone or as a combination thereof. On the other hand, where the complex salt is formed in situ using a ferric salt and a chelating agent, these ferric salts can be used alone or as a combination thereof. Further, these chelating agents can be used alone or as a combination thereof. In each case, the chelating agent can be used in an amount more than necessary to form a ferric ion complex salt.

Silver halide solvents which are used in combination with these oxidizing agents, include thiosulfates, thiocyanates, thioureas, thioglycols, water-soluble organic diols containing sulfur or oxygen in the molecule such as 3,6-dithia-1,8-octadiol, etc, The blix solution can further contain other conventional additives for the blix solution such as salts capable of buffering the pH, salts capable of controlling swelling, or stabilizers such as sulfites. In particular, when a thiosulfate is used as the silver halide solvent, it is preferred to use sulfites. Representative examples of the compositions of these blix solutions are described in German Pat. No. 866,605, British Pat. No. 1,014,391, German Pat. No. 966,410, U.S. Pat. No. 3,582,322, etc., and are described in *The British Journal of Photography*, Vol. 107, pages 122 to 123, and page 126 (1960).

Color developers which can be used in combination with the method of the present invention are those conventionally used and examples include an alkaline aqueous solution of an aromatic primary amine color developing agent, preferably containing benzyl alcohol. Examples of color developing agents include phenylenediamine derivatives such as N,N-diethyl-p-phenylenediamine sulfate, 4-amino-N-ethyl-N-$\beta$-hydroxyethyl aniline sulfate, 3-methyl-4-amino-N-ethyl-p-methanesulfoamidoethylaniline sesquisulfate monohydrate, 3-methyl-4-amino-N-ethyl-N-$\beta$-hydroxyethylaniline sulfate, 3-methyl-4-amino-N,N-diethylaniline chlorate, and other known aromatic primary amine color developing agents. In addition, the alkali metal salts of sulfites, carbonates, bisulfites, bromides, iodides, antifoggants, development accelerators, solvents such as diethylene glycol, and other additives for developers can be also present in the developer solutions.

Color photographic materials to which the method of the present invention is to be applied, include multilayer gelatin-silver halide photosensitive materials.

The present invention will be explained in detail by reference to the following examples. Unless otherwise indicated herein, all parts, percents, ratios and the like are by weight.

EXAMPLE 1

The color photographic paper described below was printed, developed with a developer having the same composition as described below, and blixed with a blix solution having the composition described below.

The color photographic paper used was prepared in the following manner.

On a baryta paper were coated a silver bromide emulsion containing an yellow coupler dispersion, a silver chlorobromide emulsion (silver chloride; 2.0 mole %) containing a magenta coupler dispersion, a silver chlorobromide emulsion containing a cyan coupler dispersion (silver chloride: 70 mole %) and a gelatin layer containing an ultraviolet light absorbing agent to produce a color paper. Each coupler emulsion used in producing this color paper was produced by dissolving each coupler in a mixture of dibutyl phthalate and tricresyl phosphate, and by dispersing the resulting solution in a gelatin solution as a O/W emulsion using sorbitan monolaurate, Turkey red oil, and sodium dodecylbenzene sulfonate as emulsifying agents. As couplers, 1-(2′,4′,6′-trichlorophenyl)-3-[3″-(2‴,4‴-di-tert-amylphenoxyacetamido)-benzamido]-5-pyrazolone, 1-(hydroxy)-4-chloro-2-n-dodecylnaphthamide, and α-(2-methylbenzoyl)-aceto-(2′-chloro-5′-dodecoxycarbonyl)-anilide were used. The ultraviolet light absorbing agent used is described in Japanese Pat. No. 9586/1970. In the emulsion, 2,4-dichloro-6-hydroxy-1,3,5-triazine sodium salt was used as a hardener. The thus prepared color paper was exposed to light with a color printer and subjected to the following development processing.

| Development | Temperature (° C) | Time (min.) |
|---|---|---|
| Color Development | 30 | 6 |
| Blixing | " | 2 |
| Washing | " | 2 |
| Stabilizing Bath | " | 2 |
| Drying | " | 2 |

The color development and stabilizing processing solutions used has the following compositions.

| | |
|---|---|
| **Color Developer** | |
| Benzyl Alcohol | 12 ml |
| Diethylene Glycol | 3.5 ml |
| Sodium Hydroxide | 2.0 g |
| Sodium Sulfite | 2.0 g |
| Potassium Bromide | 0.4 g |
| Sodium Chloride | 1.0 g |
| Borax | 4.0 g |
| Hydroxylamine Sulfate | 2.0 g |
| Ethylenediamine Tetraacetate | 2.0 g |
| 4-Amino-3-methyl-N-ethyl-N-(β-sulfonamidoethyl)anilinesesquisulfate (monohydrate) | 5.0 g |
| Water to make | 1 liter |
| **Stabilizing Solution** | |
| Boric Acid | 5 g |
| Sodium Citrate | 5 g |
| Sodium Metaborate (tetrahydrate) | 3 g |
| Potassium Alum | 15 g |
| Water to make | 1 liter |

The blix solution had the following composition.

-continued

| | |
|---|---|
| **Blix Solution** | |
| Ferric Sulfate | 20 g |
| Disodium Ethylenediaminetetraacetate (dihydrate) | 36 g |
| Sodium Carbonate (monohydrate) | 17 g |
| Sodium Sulfite | 5 g |
| Ammonium Thioslfate (70% aq. soln.) | 100 ml |
| Boric Acid | 5 g |

The pH of the mixture was adjusted to 6.8, and water was added to make 1 liter.

This blix solution was repeatedly used until the content of the silver complex salt accumulated in this blix solution became about 3.0 g/liter, as silver. At this time, the iron (II) concentration was 26.4 millimole/liter.

An electrolytic cell was prepared which was 4 cm in width, 6 cm in length, and 100 cm in depth. This electrolytic cell was provided with two pairs of cathodes and anodes. A 0.1 cm × 2 cm × 100 cm stainless steel plate was used as the cathode. A membrane of polyvinyl chloride was wound at a distance of 1.5 cm from the cathode, which was wound with a carbon fiber (diameter 3 mm) as the anode so that there was no gap in the electrolytic cell (about three times).

This electrolytic cell was charged with 2 liters of the used blix solution described above, and the voltage of the electrolytic cell was set at 0.85 volt. At this time, the current was 1.2 ampere, i.e., the cathode current density was 0.15 A/dm². If the flow rate of the used blix solution was set at 80 cm per hour (2 liters), the concentration of silver after 3 hours was 2.0 g/liter, and the concentration of iron (II) after 3 hours was 1.2 millimole/liter. The sodium sulfite concentration was 4.6 g/liter, i.e., it decreased by 8%, and the ammonium thiosulfate concentration decreased to 90 ml/liter. However, the concentrations of disodium ethylenediaminetetraacetate (dihydrate), sodium carbonate (monohydrate), and boric acid remained unchanged. At this time, the pH increased to 6.9.

When the flow rate of the used blix solution was changed to 40 cm per hour (1 liter), the concentration of silver after 3 hours was 1.7 g/liter, and the concentration of iron (II) was 2.2 millimole/liter. The concentrations of sodium sulfite and ammonium thiosulfate (70%) were 4.1 g/liter (i.e., decreased by about 18%) and 99 ml/liter, respectively, but the content of the other components did not change at all. The pH increased to 6.95.

Where the regeneration was carried out in accordance with the method as described in Example 1 of U.S. Pat. No. 3,634,088 as a comparison example, the concentration of sodium sulfate decreased by about 29% in the blix solution used (the pH increased to 7.19), decreased by about 63% after the silver recovery (the pH increased to 7.97), and decreased by about 86% after the bubbling of air (the pH increased to 8.02).

As is apparent from the above description, in accordance with the method of the present invention, not only was the silver recovery substantially sufficient, but also the reduction in the amounts of the other components, particularly sodium sulfite was quite small as compared with the reduction resulting when conventional methods were employed. Furthermore, in the present invention, the change in the pH was small and the pH after the regeneration was similar to that prior to the use of the blix solution. Therefore, the method of the present invention is considered to be quite useful.

EXAMPLE 2

A used blix solution obtained in processing the color paper discribed in Example 1 was subjected to an electrolysis in the same apparatus as described in Example 1, in which the voltage was set at 1.0 volt. In this case, the anode potential was 0.30 volt relative to a saturated calomel electrode, and the cathode potential was −0.60 volt. At this time, the current was 1.6 A, that is, the cathode current density was 0.20 A/dm². When the flow rate of the blix solution was set at 80 cm per hour (2 liters), the concentration of silver after the silver recovery was 1.7 g/liter and that of iron (II) was 2.9 millmole/liter. The concentrations of sodium sulfite and ammonium thiosulfate were, respectively, 1.2 g/liter (corresponding to a reduction of 76%) and 88 ml/liter. The concentrations of the other materials, i.e., the disodium ethylenediaminetetraacetate (dihydrate), sodium sulfite (monohydrate), and boric acid did not change. At this time, the pH increased to 7.05.

If the flow rate of the blix solution was set at 40 cm per hour (1 liter), the concentration of silver after 3 hours was 1.5 g/liter and the concentration of iron (II) was 3.4 millimole/liter. The concentrations of sodium sulfite and ammonium thiosulfate decreased to 0.8 g/liter (corresponding to a reduction of 84%) and 85 ml/liter, respectively. The content of the other components did not show at all any change. At this time, the pH increased to 7.12.

EXAMPLE 3

A used blix solution obtained as in Example 1 was electrolyzed in an apparatus in which a carbon plate, in place of a carbon fiber, as the anode was placed parallel to a stainless steel plate as the cathode with a membrane interposed therebetween, and the voltage was changed to 1.7 volt. In this case, the anode potential was 0.50 volt relative to a saturated calomel electrode, and the cathode potential was −0.70 volt. At this time, the current was 1.6 A, that is, the cathode current density was 0.20 A/dm². When the flow rate of the blix solution was set at 80 cm per hour (2 liters), the concentration of silver after 3 hours was 1.8 g/liter, and the concentration of iron (II) as 36.2 millimole/liter. The concentrations of sodium sulfite and ammonium thiosulfate decreased to 0.9 g/liter (corresponding to a reduction of 82%) and 87 ml/liter, respectively. The concentrations of the other components did not change. At this time, the pH increased to 7.42.

When the flow rate of the blix solution was changed to 40 cm per hour (1 liter), the concentration of silver after 3 hours was 1.6 g/liter, and the concentration of iron (II) was 41.4 millimole/liter. The concentrations of sodium sulfite and ammonium thiosulfate decreased to 0.6 g/liter (corresponding to a reduction of 88%) and 85 ml/liter, respectively.

The contents of the other components did not change. At this time, the pH increased to 7.80.

From the above results, it is apparent that a carbon plate is effective as an anode.

EXAMPLE 4

A blix solution obtained by carrying out an electrolysis at a flow rate of 80 cm (2 liters) for 3 hours as in Example 1 was designated Sample A, and a blix solution obtained by carrying out an electrolysis at a flow rate of 40 cm (1 liter) for 3 hours as in Example 1 was designated Sample B, blix solutions obtained by carrying out electrolysis at the flow rate of 80 cm (20 liters) for 3 hours and at the flow rate of 40 cm (10 liters) for 3 hours as in Example 2 were designated Samples C and D, respectively, and blix solutions obtained by carrying out electrolysis at a flow rate of 80 cm (20 liters) for 3 hours and at a flow rate of 40 cm (10 liters) for 3 hours were designated Sampls E and F, respectively. With these samples, the clearing time and the color density were measured. The results obtained were compared with those of a fresh blix solution. In Samples E and F, insufficient de-silvering took place.

| Blix Solution | Clearing Time | Color Density | | |
|---|---|---|---|---|
| | | R | G | B |
| | (seconds) | | | |
| Fresh | 16 | 1.8 | 1.9 | 1.9 |
| Sample A | 16 | 1.8 | 1.9 | 1.9 |
| Sample B | 16 | 1.8 | 1.9 | 1.9 |
| Sample C | 16 | 1.8 | 1.9 | 1.9 |
| Sample D | 16 | 1.8 | 1.9 | 1.9 |
| Sample E | More than 20 min. | * | * | * |
| Sample F | More than 20 min. | * | * | * |
| After Use | 21 | 1.8 | 1.7 | 1.8 |

*Impossible to measure

The test conditions used in the above table were as follows.

The clearing time means the time which was required for a commercially available black and white positive cinema film fixed after development at 20° C for 2 minutes with a developer having the following composition

| | |
|---|---|
| Water | 500 ml |
| Monomethyl-p-aminophenol ½ sulfate | 3.0 g |
| Sodium Sulfite | 45.0 g |
| Hydroquinone | 12.0 g |
| Sodium Carbonate (monohydrate) | 80.0 g |
| Potassium Bromide | 2.0 g |
| Water to make | 1 liter |

(on use, the above was diluted with twice the volume of water) in a light room to become transparent upon being immersed in the blix solution.

EXAMPLE 5

A used blix solution was electrolyzed in an electrolytic cell, which was 15 cm in width, 20 cm in length, and 80 cm in depth, in accordance with the method as used in Example 1. In this case, a 0.1 cm × 18 cm × 80 cm stainless steel plate was used as the cathode, a 0.5 cm × 20 cm × 83 cm carbon plate was used as the anode, a polyvinyl chloride film was used as the membrane, and the silver halide present in the solution was removed by the method described in U.S. Pat. No. 3,369,801.

Where the voltage of the electrolytic cell was set at 0.80 V, the anode potential was 0.10 V. At this time, the cathode current was 8.4 A (current density 0.06 A.dm²).

Where the flow rate was fixed at 30 cm per hour (10 liters), the solution obtained after 3 hours contained 0.5 g/liter of silver, and 3.1 millimole/liter of iron (II) (46.0 millimole/liter prior to electrolysis). The concentration of sodium sulfite decreased only by 6% by the electrolysis, and the other components remained unchanged. The pH was 7.3 prior to the electrolysis and 6.9 after the electrolysis.

Next, where the flow rate was changed to 60 cm per hour (20 liters), the solution obtained after 3 hours contained 0.5 g/liter of silver and 2.3 millimole/liter of iron (II) (45.2 millimole/liter prior to the electrolysis). The concentration of sodium sulfite decreased only by about 14% by the electrolysis, but those of the other components did not change at all. The pH was 7.4 prior to the electrolysis and 7.0 after the electrolysis.

Thus it is apparent that the same results as in Example 1 were obtained.

EXAMPLE 6

Blix solutions produced by electrolyzing at a flow rate of 80 cm (2 liters) for 3 hours and at a flow rate of 40 cm (1 liter) for 3 hours in Example 1 were, respectively, designated a Samples G and H, and the blix solutions produced by electrolyzing at a flow rate of 30 cm (10 liters) for 3 hours and at a flow rate of 60 cm (30 liters) for 3 hours in Example 5 were, respectively, designated Samples J and K. With these samples, the desilverization time and color density were measured, which were compared with those of a fresh blix solution.

| Blix Solution | Clearing Time | Color Density | | |
|---|---|---|---|---|
| | | R | G | B |
| | (seconds) | | | |
| Fresh | 16 | 1.8 | 1.9 | 1.9 |
| Sample G | 16 | 1.8 | 1.9 | 1.9 |
| Sample H | 16 | 1.8 | 1.9 | 1.9 |
| Sample J | 16 | 1.8 | 1.9 | 1.9 |
| Sample K | 16 | 1.8 | 1.9 | 1.9 |
| After Use | 21 | 1.8 | 1.7 | 1.8 |

The test conditions used in the above table were as described in Example 4.

While the invention has been described in detail and with reference to specific embodiments thereof, it will be apparent to one skilled in the art that various changes and modifications can be made therein without departing from the spirit and scope thereof.

What is claimed is:

1. A process for electrolyzing a used blix solution obtained in processing color photographic materials, said blix solution originally containing an iron (III) chelated bleaching agent and a silver halide solvent, comprising, providing an electrolytic cell having a cathode compartment and an anode compartment having a liquid flow path therebetween and separated by a porous membrane;

feeding into said cathode compartment at a flow rate of 3 liters/hour or more said blix solution;

applying to the cathode of said electrolytic cell a potential of from about −0.20 to about −0.7 volts and to the anode a potential of about −0.10 to 0.50 volts while passing said blix solution from the cathode compartment to the anode compartment and controlling the cathode potential, anode potential and the current densities of said anode and cathode so as not to decompose the silver halide solvent.

2. The process according to claim 1, wherein the cathode is made of stainless steel.

3. The process according to claim 1, wherein the anode is made of carbon, lead oxide, platinum or gold.

4. The process according to claim 1, wherein the membrane is made of a cellulose acetate film, a cellophane film, a copper ferrocyanide film, a bladder membrane, an intestinal wall membrane, an agar film, an asbestos plate, a clay plate, a sintered glass, glass wool, or a micro-porous synthetic polymer film.

5. The process according to claim 1, wherein the electrolytic cell is made of an electrically insulative material.

6. The process according to claim 1, wherein the insulative material is glass, hard rubber, wood, or a synthetic resin.

7. The process according to claim 1, wherein said anode is a carbon fiber.

8. The process according to claim 7, wherein the carbon fiber is in the form of a felt, a twill, a plain weave. fabric, or a string.

9. The process according to claim 1, wherein the synthetic polymer is selected from the group consisting of polyvinyl chloride, polystyrene, a polysulfone, polypropylene, and a polyester.

10. The process according to claim 1, wherein the synthetic resin is selected from the group consisting of polyvinyl chloride, polymethyl methacrylate, polyethylene, polypropylene, polystyrene, and a phenol-formaldehyde resin.

11. The process according to claim 1, wherein the silver halide solvent is selected from the group consisting of a thiosulfate, a thiocyanate, a thiourea, a thioglycol, and a water-soluble organic diol containing sulfur and oxygen in the molecule.

12. The process according to claim 1, wherein the anode current density is about 0.7 $A/dm^2$ or less.

13. The process according to claim 1, wherein the cathode current density is about 0.01 $A/dm^2$ or higher.

14. The process according to claim 1 wherein the porous separator is a membrane which will allow elections and liquids to pass therethrough, but not large ions and molecules.

* * * * *

UNITED STATES PATENT AND TRADEMARK OFFICE

CERTIFICATE OF CORRECTION

PATENT NO. : 4,013,527

DATED : March 22, 1977

INVENTOR(S) : Yoshio IDOTA et al

It is certified that error appears in the above-identified patent and that said Letters Patent are hereby corrected as shown below:

IN THE HEADING:

Foreign Application Priority Data

Delete "Aug. 7, 1974 New Zealand.....90545"

Insert -- Aug. 7, 1974 Japan.....49-90545 --

Signed and Sealed this

Seventh Day of June 1977

[SEAL]

*Attest:*

RUTH C. MASON
*Attesting Officer*

C. MARSHALL DANN
*Commissioner of Patents and Trademarks*